US008205947B2

(12) United States Patent
Morrison

(10) Patent No.: US 8,205,947 B2
(45) Date of Patent: Jun. 26, 2012

(54) METHOD OF BREAKING BRITTLE SOLIDS

(75) Inventor: Thomas A. Morrison, Delta (CA)

(73) Assignee: 14007 Mining Inc., Richmond, BC (CA)

( * ) Notice: Subject to any disclaimer, the term of this patent is extended or adjusted under 35 U.S.C. 154(b) by 613 days.

(21) Appl. No.: 11/991,710

(22) PCT Filed: Sep. 6, 2006

(86) PCT No.: PCT/CA2006/001462

§ 371 (c)(1),
(2), (4) Date: Feb. 26, 2009

(87) PCT Pub. No.: WO2007/028238

PCT Pub. Date: Mar. 15, 2007

(65) Prior Publication Data

US 2009/0184563 A1 Jul. 23, 2009

Related U.S. Application Data

(60) Provisional application No. 60/714,195, filed on Sep. 6, 2005.

(51) Int. Cl.
*F42D 3/04* (2006.01)
*E21C 37/12* (2006.01)

(52) U.S. Cl. ..... 299/13; 175/12

(58) Field of Classification Search ..... 299/13, 299/14, 16; 175/2, 4.6, 11, 12, 14
See application file for complete search history.

(56) References Cited

U.S. PATENT DOCUMENTS

| | | | | |
|---|---|---|---|---|
| 4,372,213 | A | 2/1983 | Rozner et al. | |
| 5,573,307 | A * | 11/1996 | Wilkinson et al. | 299/14 |
| 5,771,984 | A * | 6/1998 | Potter et al. | 175/14 |
| 5,773,750 | A | 6/1998 | Jae et al. | |
| 6,536,525 | B1 * | 3/2003 | Haugen et al. | 175/4.6 |
| 6,708,762 | B2 * | 3/2004 | Haugen et al. | 175/4.6 |
| 6,969,123 | B2 * | 11/2005 | Vinegar et al. | 299/14 |
| 2003/0137181 | A1 * | 7/2003 | Wellington et al. | 299/5 |
| 2003/0141063 | A1 * | 7/2003 | Haugen et al. | 175/4.6 |
| 2003/0164238 | A1 * | 9/2003 | Vinegar et al. | 299/14 |
| 2003/0173085 | A1 * | 9/2003 | Vinegar et al. | 299/14 |

FOREIGN PATENT DOCUMENTS

| | | |
|---|---|---|
| EP | 0692611 B1 | 1/1996 |
| WO | WO 02/073120 A1 | 9/2002 |

* cited by examiner

*Primary Examiner* — Frederick L Lagman
(74) *Attorney, Agent, or Firm* — Kilpatrick Townsend & Stockton LLP

(57) ABSTRACT

A method for fracturing a solid material is disclosed. The method comprises boring at least one bore hole in the solid material, the bore hole having a bottom and an open top. Reactive materials capable of an exothermic reaction to produce a liquid and a gas are introduced into the bore hole. The bore hole is then sealed at the open top. The exothermic reaction is then initiated to produce the liquid and the gas. The pressures generated by the liquid and gas in the bore hole result in fracturing of the solid material.

24 Claims, 2 Drawing Sheets

METHOD OF BREAKING BRITTLE SOLIDS

CROSS-REFERENCE TO RELATED APPLICATIONS

This application is a National Stage of International Application No. PCT/CA2006/001462, filed Sep. 6, 2006, and which claims the benefit of U.S. Provisional Patent Application No. 60/714,195, filed Sep. 6, 2005, the disclosures of both applications being incorporated herein by reference.

BACKGROUND OF THE INVENTION

1. Field of Invention

The present invention relates to fracturing solid materials in general and to a method of fracturing rocks and concrete by containing an exothermic expansive reacting within a bore hole in particular.

2. Description of Related Art

It is often desirable to fracture or break large bodies of solid materials into more manageable sizes for transportation and further processing. Such solid material may be rock or concrete in the fields of mining, civil engineering or demolition work for example. Methods of fracturing such materials have typically been either mechanical or chemical.

Mechanical methods of rock breaking may include hammering or impacting the solid material, for example with a jack hammer. Mechanical methods may also include cutting or shearing, applying pressure by wedges as well as any means of applying a shock to the solid material. Chemical methods have typically relied on a chemical reaction within a cavity or bore of the solid material to produce a large amount of pressure within the bore. This pressure serves to fracture the solid material between the bore and a free surface. Chemical methods typically include the use of explosives for most large-scale operations. Chemical methods may also include the injection of an expanding foam into the bore holes or other suitable pressure producing methods.

The chemical methods of fracturing solid materials are typically preferred for a variety of reasons. Chemical methods, such as explosives, enable a large number of bore holes to be filled and exploded at the same time. This enables a large volume of solid material to be fractured at a single event. In addition, through timing of the explosions successively within an array of bore holes, the volume of solid material fractured may be further multiplied. The ability to fracture large volumes of material at a time leads to significant efficiency advantages. Efficiency in blasting operations is typically measured in terms of the amount of labor, equipment and materials required to break a volume of material. Explosive techniques tend to be efficient due to the ability to bore a large number of bore holes which may be fractured during a single event.

The use of explosives however has a number of disadvantages, many of which primarily result from the speed of the chemical reaction within the explosive material. As the explosive reaction is completed during a period of several milliseconds, the material surrounding the bore hole does not have sufficient time to expand, resulting in shattering of the material followed by displacement. This shattering of the material results in pieces of solid material that are no longer attached to any surrounding material and are briefly subjected to the violent expulsive force of the explosion. Accompanying this reaction is therefore a large amount of noise, flying debris, ground and air vibration and possible toxic fumes from the explosives themselves.

In addition, the use of explosives also increases the hazards of the excavation due to any possible unexploded material. If such unexploded material is lodged in the surrounding unfractured rock, it may be subject to being ignited by subsequent drilling operations. In addition, any unexploded material entrained with the fractured material may cause damage or danger to workers during subsequent collection and processing of the material. It will also be appreciated that due to the hazardous nature of explosives, specialized personnel are required to handle, operate and oversee these operations.

Thermite is a known chemical composition consisting of a mixture of particles of a metal oxide, such as, for example, FeO, iron (II) oxide or ferrous oxide and a reactive metal, such as, for example, aluminum. Thermite is an exothermic reactive material that will chemically react with itself once initiated thereby producing aluminum oxide and free elemental iron, for example, as well as releasing a large amount of heat.

Thermite has been proposed for use in breaking or fracturing solid material in U.S. Pat. No. 5,773,750 to Jae et al. Jae et al. however applies thermite into a bore hole on the end of a rod or stinger. The stinger of Jae et al. includes electrodes which serve to initiate the reaction of the thermite. As Jae et al. applies the thermite to the end of a stinger, only a single bore hole may be fractured at a time. Accordingly, Jae et al. is not capable of fracturing a large volume of solid material during a single event, and does not therefore achieve the efficiency advantages of typical explosive methods.

What is desirable is a method of fracturing rock by pressure that is applicable to a plurality of bore holes simultaneously wherein the pressure is developed and applied slow enough so as to diminish flying debris, air blast, ground vibration and excessive noise.

SUMMARY OF THE INVENTION

The present invention provides a method of fracturing solid material using a thermite reaction in a plurality of sealed bore holes.

According to a first embodiment of the present invention, there is provided a method for fracturing a solid material. The method comprises boring at least one bore hole in the solid material, the bore hole having a bottom and an open top and introducing into the at least one bore hole reactive materials capable of an exothermic reaction to produce a liquid and a gas. The method further includes sealably enclosing the bore hole at the open top and initiating the exothermic reaction to produce the liquid and the gas.

According to a further embodiment of the present invention, there is provided a kit for fracturing a solid material. The kit comprises reactive materials capable of an exothermic reaction to produce a liquid and a gas, and an igniter for initiating the reaction.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
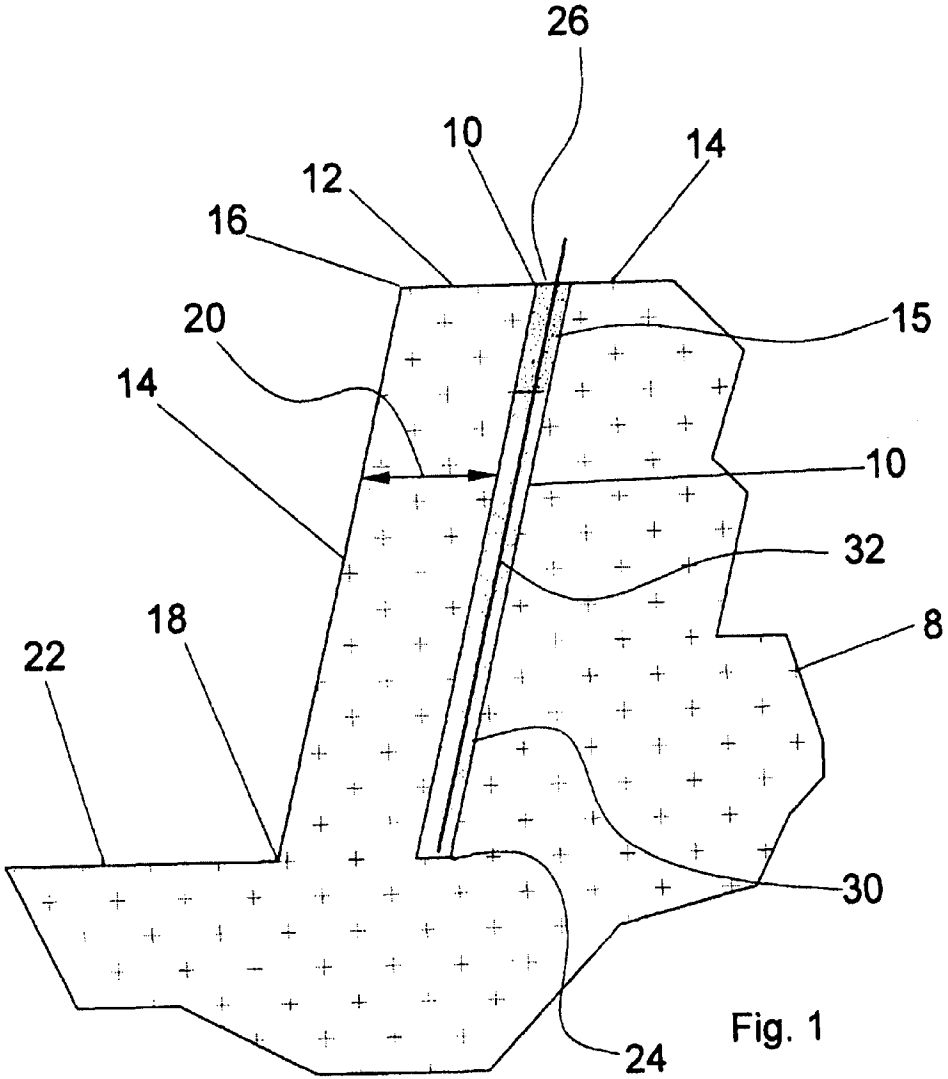
FIG. 1 is an elevation cross section of a body of solid material having a bore hole according to a first embodiment of the present invention.

Referring to FIG. 1, a bore hole 10 for fracturing a body of solid material 8 according to a first embodiment of the invention is shown. The solid material has a top surface 12 and a free surface 14. The free surface 14 has a top edge 16 and a bottom edge 18. The solid material may comprise rock, hard-packed soil, concrete or any other solid material that is desired to be fractured for removal. The solid material may also have an adjacent surface 22 extending from the bottom edge 18 of the free surface 14. The adjacent surface 22 may also be substantially parallel to the top surface 12.

The bore hole 10 may be positioned substantially parallel to the free surface 14 by a distance indicated by arrow 20 in the embodiment shown in FIG. 1. In other embodiments, the bore hole 10 may be angularly aligned relative to the free surface 14. The bore hole 10 comprises an elongate bore having a bottom 24 and an open top 26. According to the method of the present invention, the bore hole 10 is substantially filled with reactive materials 30 capable of exothermically reacting to produce a liquid and a gas.

At least one of the reactive materials 30 may comprise a mixture of a metal oxide and a reactive metal commonly known as thermite. The metal oxide and reactive metal are typically combined in powdered form. The metal oxide may comprise ferrous ferric oxide ($Fe_3O_4$), ferric oxide ($Fe_2O_3$), cupric oxide (CuO), stannic oxide ($SnO_2$), titanium dioxide ($TiO_2$), manganese dioxide ($MnO_2$) or chromium sesquioxide ($Cr_2O_3$) for example. It will be appreciated that other metal oxides will also be useful. Another of the reactive materials 30 may comprise a gas producing substance operable to release a gas when heated. The gas producing substance may comprise water, hydrogen peroxide or any other suitable substance. The gas released may preferably be a non-toxic gas such as gaseous water vapor or oxygen for example.

The open top 26 is then sealably closed with a plug 15 through which an ignition means may be inserted. The plug may comprise an expanding concrete, polymer, an expanding body engaging the walls of the bore hole interlocking particles of a material such as gravel or any other suitable means. Plugs 15 are designed or selected so as to adequately resist the pressures developed within the bore holes. The methods of calculating the required strength and dimensions of such a plug are well known in the art, for example as provided in the US Federal Highway Administration Report FHWA-RD-75-128, *Lateral Support Systems and Underpinning*, Vol 1, *Design and Construction.*

An exothermic reaction in the reactive materials 30 is then initiated by the ignition means 32. The ignition means 32 may be emplaced in the bore hole 10 before, during or after the reactive materials 30 are introduced into the bore hole 10 and before, during or after the plug 15 is emplaced. The ignition means 32 may be capable of being initiated in a manner such that a person initiating the reaction is at a safe distance from the bore hole 10. The ignition means 32 may, for example, be a fuse burning at a particular rate, such as a length of magnesium wire or an electric igniter, however it will be appreciated that other ignition means are also possible. The ignition means may comprise two or more parts such as, for example, a fuse burning at a particular rate which in turn ignites a chemical charge embedded in the reactive materials. The chemical charge may then initiate the exothermic reaction in the reactive materials.

By way of example, when using a mixture $Fe_2O_3$ or ferrous ferric oxide and aluminum as one of the reactive materials, the resulting product will be liquid iron and aluminum oxide. Those of skill in the art will appreciate that the use of other initial compositions will have products similarly related to the starting components. Such an exothermic reaction produces a sufficiently high enough temperature within the bore hole 10 that the water decomposes to water and hydrogen. Accordingly, two of the products of the reaction are a gas, for example oxygen, and a liquid metal, for example iron. The chemical reaction according to this example is as follows:

$$Fe_2O_3(s)+2Al(s)\rightarrow Al_2O_3(l)+2Fe(l);\ \Delta H=-851.5\ KJ/mol$$

Such a reaction may produce temperatures of up to 3500° C. The temperatures generated may be enhanced due to the enclosing of the reaction within the bore holes 10.

The gas released by the gas producing substance may preferably be a non-toxic gas such as gaseous water vapor or oxygen for example. When water, for example, is used, the released gas will be water vapor which is vaporized due to the large amount of heat generated during the thermite reaction. The use of water may also advantageously produce a secondary reaction between the molten aluminum and the water vapor according to the following reaction:

$$2Al+6H2O\rightarrow 2Al(OH)3+3H2$$

to produce additional hydrogen gas thereby further raising the pressure in the bore holes. In addition, hydrogen peroxide or $H_2O_2$ may also be utilized during the present method. The use of hydrogen peroxide results in the decomposition of the hydrogen peroxide when heated by the thermite reaction according to the following reaction:

$$2H_2O_2\rightarrow 2H_2O+O_2$$

It will be appreciated that the oxygen and water vapor produced by the decomposition of hydrogen peroxide will produce a greater volume of gas than that of the water vaporization alone and will therefore result in a larger pressure developed within the bore hole.

The gas produced by the current method will have a volume greater than that occupied by the water. Consequently the pressure within the sealed bore hole 10 will be raised until a sufficient pressure is developed so as to fracture the surrounding solid material. When fractures are formed, the liquid metal will flow into these fractures thereby coming into contact with the cooler surrounding material. The liquid iron will then solidify thereby resealing the fractures and bore hole 10 so that further fractures may be formed until such time as the surrounding material is sufficiently fractured so as to permit removal by conventional means. It will be appreciated that the amount of thermite and water used, for example in each bore hole, may be varied so as to produce an amount of pressure within the bore hole so as to fracture the surrounding solid material. Methods of calculating the burst pressure of rock and other materials are well known in the art. Accordingly, calculations may be used to determine the relative amounts of thermite and water, for example, required to generate the required pressure within the bore hole.

Figure 2:
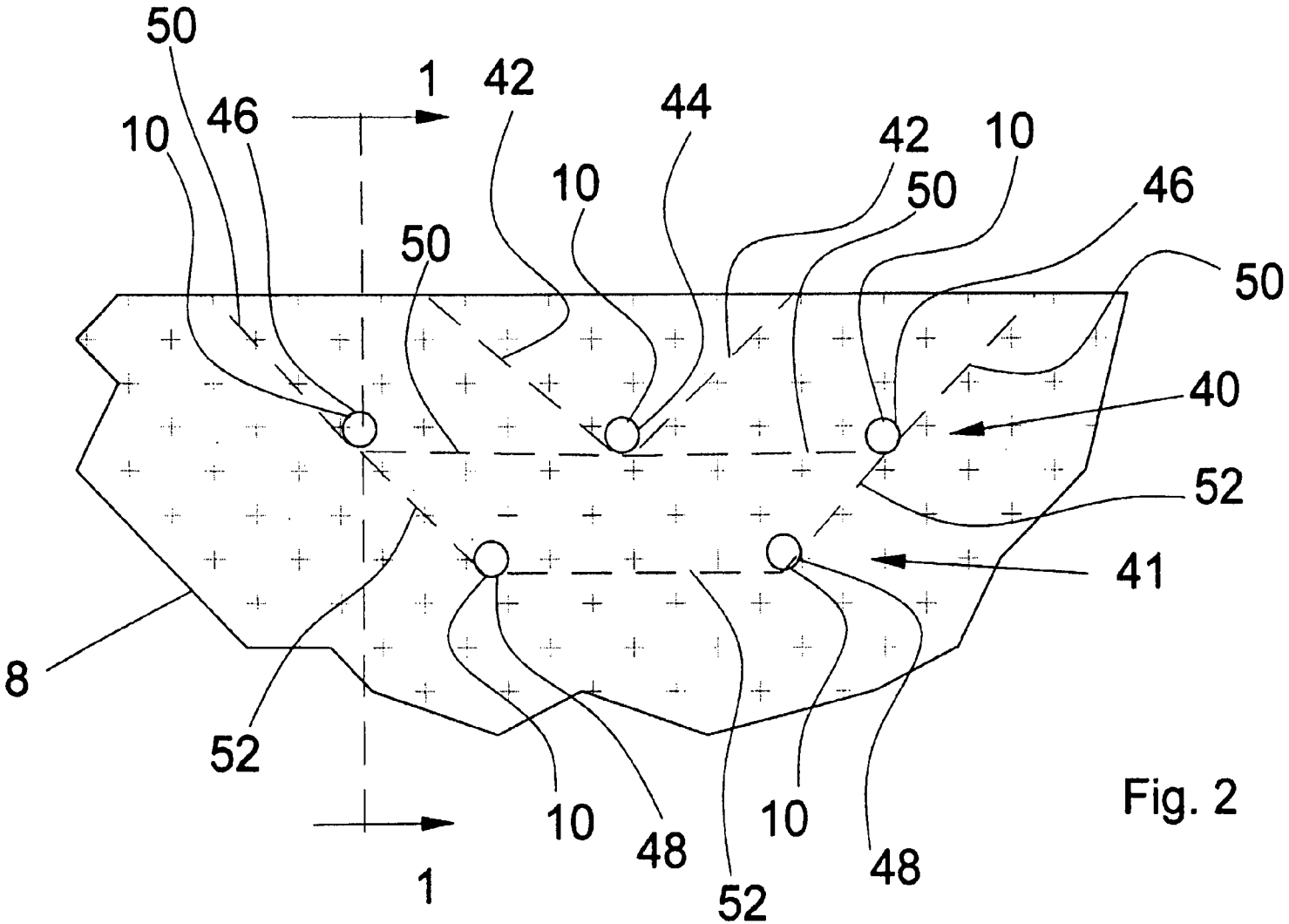
FIG. 2 is a plan view of a plurality of bore holes located in the body of FIG. 1.

Now referring to FIG. 2, a drilling pattern for a plurality of bore holes in a body of solid material 8 is shown. As shown in FIG. 2, five bore holes 10 are shown in first and second staggered rows generally indicated by 40 and 42, respectively. It will be appreciated that other arrangements will be possible such as wherein the columns of the rows are aligned, for example.

When a method of the present invention fractures rock, the majority of the material that is fractured from a single bore hole 10 will be in the form of a wedge shape extending from the bore hole as indicated at 42 in FIG. 2 for a first stage 44 bore hole 10. The initiation of the reaction within the bore holes 10 may also be sequenced so as to remove successive layers of solid material into the body. FIG. 2 shows a possible arrangement for successively initiating the reaction of first, second and third stages 44, 46 and 48, respectively, of bore holes. As set out above, the reaction in the first stage 44 will fracture the solid material extending from the bore hole 10 in a wedge shape to the free surface. Thereafter the reaction may be initiated in the second stage 46 thereby fracturing the solid material indicated by the lines 50. Thereafter the reaction may be initiated in the third stage bore holes 48 thereby fracturing the solid material indicated by the lines 52. Such a sequencing of bore holes 10 is known in the art when using explosives. Such sequenced bore holes 10 may be arranged in an array distributed across the top surface 12 of the solid material 8 of FIG. 1. It will be appreciated that the bore holes may also be distributed across any surface, such as for example a non-horizontal surface, so as to fracture the rock towards a free surface. The array may be arranged such that the columns and rows are in alignment or such individual bore holes in alternate rows are located at positions adjacent to spaces between bore holes in adjacent rows. It will be appreciated by those of skill in the art that other known arrangements for the array may be selected so as to achieve the desired results.

While specific embodiments of the invention have been described and illustrated, such embodiments should be considered illustrative of the invention only and not as limiting the invention as construed in accordance with the accompanying claims.

What is claimed is:

1. A method for fracturing a solid material, the method comprising:

boring at least one bore hole in the solid material, the bore hole having a closed end within the material and an open end at a surface of the material;

introducing into said at least one bore hole reactive materials capable of an exothermic reaction to produce a liquid and a gas;

sealably enclosing said bore hole at said open end to create a sealed bore hole; and initiating the exothermic reaction to produce the liquid and the gas to generate pressure within the sealed bore hole to fracture the solid material wherein the liquid tends to seal initial fractures which develop to assist in maintaining the sealed bore hole thereby allowing pressure to develop.

2. The method of claim 1 wherein at least one of said reactive materials comprises a mixture of a metal oxide and a reactive metal.

3. The method of claim 2 wherein said metal oxide is selected from the group consisting of ferrous ferric oxide, ferric oxide, cupric oxide, stannic oxide, titanium dioxide, manganese dioxide and chromium sesquioxide.

4. The method of claim 2 wherein said reactive metal is selected from the group consisting of aluminum, sodium, potassium and magnesium.

5. The method of claim 1 wherein at least one of said reactive materials comprises a gas producing substance.

6. The method of claim 5 wherein said gas producing substance is water.

7. The method of claim 5 wherein said gas producing substance is hydrogen peroxide.

8. The method of claim 1 wherein at least one of said reactive materials comprises a liquid containing oxygen wherein oxygen is released when said exothermic reaction occurs.

9. The method of claim 1 wherein said boring step comprises boring a plurality of said bore holes.

10. The method of claim 9 wherein said boring step comprises boring said plurality of bore holes in a surface of the solid material.

11. The method of claim 10 wherein said boring step comprises boring said plurality of bore holes in two orthogonal directions across said surface.

12. The method of claim 11 wherein said boring step comprises boring said plurality of bore holes evenly in said two orthogonal directions.

13. The method of claim 9 wherein said boring step comprises boring said plurality of bore holes in an array.

14. The method of claim 9 wherein said boring step comprises boring said plurality of bore holes in rows and columns.

15. The method of claim 9 wherein said boring step comprises boring individual bore holes in alternate rows in positions adjacent spaces between bore holes in adjacent rows.

16. The method of claim 1 wherein the step of initiating the exothermic reaction comprises introducing an igniter into the reactive materials and using the igniter to initiate the exothermic reaction.

17. A kit for fracturing a solid material, the kit comprising reactive materials capable of an exothermic reaction to produce a liquid and a gas, and an igniter for initiating the reaction wherein the reactive materials are introducible into at least one bore hole formed in the solid material to create a sealed bore hole and upon initiation by the igniter the production of the liquid and the gas generates pressure within the sealed bore hole to fracture the solid material with the liquid tending to temporarily seal initial fractures to maintain the sealed bore hole and assist pressure to develop.

18. The kit of claim 17 wherein at least one of said reactive materials comprises a mixture of a metal oxide and a reactive metal.

19. The kit of claim 18 wherein said metal oxide is selected from the group consisting of ferrous ferric oxide, ferric oxide, cupric oxide, stannic oxide, titanium dioxide, manganese dioxide and chromium sesquioxide.

20. The kit of claim 18 wherein said reactive metal comprises aluminum, sodium, potassium, and magnesium.

21. The kit of claim 17 wherein at least one of said reactive materials comprises a gas producing substance.

22. The kit of claim 21 wherein said gas producing substance is water.

23. The kit of claim 21 wherein said gas producing substance is hydrogen peroxide.

24. The kit of claim 17 wherein at least one of said reactive materials comprises a liquid containing oxygen wherein oxygen is released when said exothermic reaction occurs.

* * * * *